US005221361A

United States Patent [19]

Anton et al.

[11] Patent Number: 5,221,361

[45] Date of Patent: Jun. 22, 1993

[54] COMPOSITIONS OF 1,1,1,2,2,5,5,5,-OCTAFLUORO-4-TRIFLUOROMETHYLPENTANE AND USE THEREOF FOR CLEANING SOLID SURFACES

[75] Inventors: Douglas R. Anton, Claymont; Frank J. Weigert, Wilmington, both of Del.

[73] Assignee: E. I. Du Pont de Nemours and Company, Wilmington, Del.

[21] Appl. No.: 755,460

[22] Filed: Sep. 4, 1991

Related U.S. Application Data

[62] Division of Ser. No. 568,807, Aug. 17, 1990, Pat. No. 5,073,290.

[51] Int. Cl.[5] ..... B08B 3/00; C11D 7/30; C11D 7/50; C23G 5/028

[52] U.S. Cl. ..... 134/38; 134/12; 134/31; 134/40; 134/42; 203/67; 252/153; 252/162; 252/170; 252/171; 252/172; 252/364; 252/DIG. 9

[58] Field of Search ..... 252/162, 170, 171, 172, 252/364, DIG. 9, 153; 203/67; 134/39, 12, 31, 38, 40, 42

[56] References Cited

U.S. PATENT DOCUMENTS

| | | | |
|---|---|---|---|
| 2,999,815 | 9/1961 | Eiseman | 252/171 |
| 2,999,817 | 9/1961 | Bower | 252/172 |
| 3,573,213 | 5/1971 | Burt | 252/172 |
| 3,728,268 | 4/1973 | Burt | 252/170 |
| 3,789,006 | 1/1974 | McMillan et al. | 252/171 |
| 3,881,949 | 5/1975 | Brock | 134/31 |
| 3,903,009 | 9/1975 | Bauer et al. | 252/171 |
| 4,324,930 | 4/1982 | von Halasz | 570/134 |
| 4,715,900 | 12/1987 | Cannon et al. | 134/31 |
| 4,947,881 | 8/1990 | Magid et al. | 134/40 |
| 5,059,728 | 10/1991 | Li et al. | 570/134 |
| 5,073,288 | 12/1991 | Anton | 252/162 |
| 5,073,290 | 12/1991 | Anton et al. | 252/162 |
| 5,076,956 | 12/1991 | Anton | 252/162 |
| 5,097,082 | 3/1992 | Anton | 570/175 |
| 5,118,359 | 6/1992 | Li et al. | 134/42 |
| 5,118,360 | 6/1992 | Li et al. | 134/42 |

FOREIGN PATENT DOCUMENTS 431458 6/1991 European Pat. Off. .

OTHER PUBLICATIONS

Snegirev, V. F., et al., Bull. Acad. Sci. USSR, Div. Chem. Sci. [English Translation], (12), 2489 (1984).

Li Jisen, et al., Shanghai Inst. Org. Chem., Youji Huave, vol. 1, pp. 40–42, 24 (1984).

*Primary Examiner*—Linda Skaling

[57] ABSTRACT

Mixtures of the compound 1,1,1,2,2,5,5,5-octafluoro-4-trifluoromethylpentane with alcohols, ethers, esters, ketones, nitrogen-containing organic compounds, and halogenated hydrocarbons are disclosed; as is a process for cleaning a solid surface which comprises treating the surface with said mixtures. Binary mixtures of 1,1,1,2,2,5,5,5-octafluoro-4-trifluoromethylpentane with about 5 to 13 weight percent methanol, with about 2 to 10 weight percent ethanol, with about 3 to 11 weight percent isopropanol, with about 50 to 58 weight percent dichloromethane, and with about 1 to 9 weight percent acetonitrile, are disclosed as azeotrope or azeotrope-like compositions and are particularly suited for use where solvent recovery and reuse is practiced.

13 Claims, No Drawings

COMPOSITIONS OF 1,1,1,2,2,5,5,5,-OCTAFLUORO-4-TRIFLUOROMETHYLPENTANE AND USE THEREOF FOR CLEANING SOLID SURFACES

This is a division of application Ser. No. 07/568,807, filed Aug. 17, 1990, now U.S. Pat. No. 5,073,290.

FIELD OF THE INVENTION

This invention relates to halogen substituted hydrocarbon compounds, their compositions and uses, and more particularly to fluorine-substituted hydrocarbons, their mixtures with solvents such as ethanol, methanol, isopropanol, methylene chloride or acetonitrile and the use thereof for cleaning solid surfaces.

BACKGROUND OF THE INVENTION

Various organic solvents have been used as cleaning liquids for the removal of contaminants from contaminated articles and materials. Certain fluorine-containing organic compounds such as 1,1,2-trichloro-1,2,2-trifluoroethane have been reported as useful for this purpose, particularly with regard to cleaning organic polymers and plastics which may be sensitive to other more common and more powerful solvents such as trichloroethylene or perchloroethylene. Recently, however, there have been efforts to reduce the use of certain compounds such as trichlorotrifluoroethane which also contain chlorine because of a concern over their potential to deplete ozone, and to thereby affect the layer of ozone that is considered important in protecting the earth's surface from ultraviolet radiation.

Boiling point, flammability and solvent power can often be adjusted by preparing mixtures of solvents. For example, certain mixtures of 1,1,2-trichloro-1,2,2-trifluoroethane with other solvents (e.g., isopropanol and nitromethane) have been reported as useful in removing contaminants which are not removed by 1,1,2-trichloro-1,2,2-trifluorethane alone, and in cleaning articles such as electronic circuit boards where the requirements for a cleaning solvent are relatively stringent, (i.e., it is generally desirable in circuit board cleaning to use solvents which have low boiling points, are non-flammable, have low toxicity, and have high solvent power so that flux such as rosin and flux residues which result from soldering electronic components to the circuit board can be removed without damage to the circuit board substrate).

While boiling, flammability, and solvent power can often be adjusted by preparing mixtures of solvents, the utility of the resulting mixtures can be limited for certain applications because the mixtures fractionate to an undesirable degree during use. Mixtures can also fractionate during recovery, making it more difficult to recover a solvent mixture with the original composition. Azeotropic compositions, with their constant boiling and constant composition characteristics, are thus considered particularly useful.

Azeotropic compositions exhibit either a maximum or minimum boiling point and do not fractionate upon boiling. These characteristics are also important in the use of the solvent compositions in certain cleaning operations, such as removing solder fluxes and flux residues from printed circuit boards. Preferential evaporation of the more volatile components of the solvent mixtures, which would be the case if the mixtures were not azeotropes, or azeotrope-like, would result in mixtures with changed compositions which may have less desirable properties (e.g., lower solvency for contaminants such as rosin fluxes and/or less inertness toward the substrates such as electrical components).

Azeotropic characteristics are also desirable in vapor degreasing operations where redistilled material is usually used for final rinse-cleaning. Thus, the vapor defluxing or degreasing system acts as a still. Unless the solvent composition exhibits a constant boiling point (i.e. is an azeotrope or is azeotrope-like) fractionation will occur and undesirable solvent distribution may act to upset the safety and effectiveness of the cleaning operation.

A number of azeotropic compositions based upon halohydrocarbons containing fluorine have been discovered and in some cases used as solvents for the removal of solder fluxes and flux residues from printed circuit boards and for miscellaneous vapor degreasing applications. For example, U.S. Pat. No. 2,999,815 discloses the azeotrope of 1,1,2-trichloro-1,2,2-trifluoroethane with acetone; U.S. Pat. No. 3,903,009 discloses a ternary azeotrope of 1,1,2-trichloro-1,2,2-trifluoroethane with nitromethane and ethanol; U.S. Pat. No. 3,573,213 discloses an azeotrope of 1,1,2-trichloro-1,2,2-trifluoroethane with nitromethane; U.S. Pat. No. 3,789,006 discloses the ternary azeotrope of 1,1,2-trichloro-1,2,2-trifluoroethane with nitromethane and isopropanol; U.S. Pat. No. 3,728,268 discloses the ternary azeotrope of 1,1,2-trichloro-1,2,2-trifluoroethane with acetone and ethanol; U.S. Pat. No. 2,999,817 discloses the binary azeotrope of 1,1,2-trichloro-1,2,2-trifluoroethane and methylene chloride (i.e., dichloromethane); and U.S. Pat. No. 4,715,900 discloses ternary compositions of trichlorotrifluoroethane, dichlorodifluoroethane, and ethanol or methanol.

As noted above, many solvent compositions which have proven useful for cleaning contain at least one component which is a halogen-substituted hydrocarbon containing chlorine, and there have been concerns raised over the ozone depletion potential of halogen-substituted hydrocarbons which contain chlorine. Efforts are being made to develop compositions which may at least partially replace the chlorine containing components with other components having lower potential for ozone depletion. Azeotropic compositions of this type are of particular interest.

Unfortunately, as recognized in the art, it is not possible to predict the formation of azeotropes and this obviously complicates the search for new azeotropic systems which have application in this field. Nevertheless, there is a constant effort in the art to discover new azeotropes or azeotrope-like systems which have desirable solvency characteristics and particularly a greater range of solvency power.

SUMMARY OF THE INVENTION

This invention provides novel mixtures of the fluorohydrocarbon compound, 1,1,1,2,2,5,5,5-octafluoro-4-trifluoromethylpentane (HFC-54-11mmzf) with miscible solvents such as alcohols (e.g., methanol, ethanol, isopropanol, etc.), ethers (e.g., tetrahydrofuran, etc.), esters, ketones (e.g., acetone, etc.), nitrogen-containing organic compounds (e.g., acetonitrile, nitromethane, etc.) and halogenated hydrocarbons (e.g., dichloromethane, 1,1,2-trichloro-1,2,2-trifluoroethane, dichlorodifluoroethane, trans-1,2-dichloroethene, trichloroethene, etc.). Mixtures with miscible solvents which form an azeotrope or azeotrope-like composition are preferred; and most preferred are mixtures of compounds which contain no chlorine.

There are provided in accordance with this invention azeotrope or azeotrope-like compositions comprising an admixture of effective amounts of 1,1,1,2,2,5,5,5-octafluoro-4-trifluoromethylpentane and an alcohol selected from the group consisting of methanol, ethanol, and isopropanol including, more specifically, an admixture of about 91 weight percent HFC-54-11mmzf and about 9 weight percent methanol, an admixture of about 94 weight percent HFC-54-11mmzf and about 6 weight percent ethanol, and an admixture of about 93 weight percent HFC-54-11mmzf and about 7 weight percent isopropanol. There are further provided in accordance with this invention azeotrope or azeotrope-like compositions comprising an admixture of effective amounts of 1,1,1,2,2,5,5,5-octafluoro-4-trifluoromethylpentane and a chlorohydrocarbon such as dichloromethane including, more specifically, an admixture of about 46 weight percent HFC-54-11mmzf and 54 weight percent dichloromethane. There are also provided in accordance with this invention azeotrope or azeotrope-like compositions comprising an admixture of effective amounts of 1,1,1,2,2,5,5,5-octafluoro-4-trifluoromethylpentane and a nitrogen-containing organic compound such as acetonitrile including, more specifically, an admixture of about 95 weight percent HFC-54-11mmzf and about 5 weight percent acetonitrile.

The mixtures of 1,1,1,2,2,5,5,5-octafluoro-4-trifluoromethylpentane with miscible solvents, and particularly azeotropic compositions of HFC-54-11mmzf with solvents are well suited for solvent cleaning applications.

DETAILED DESCRIPTION OF THE INVENTION

The compound 1,1,1,2,2,5,5,5-octafluoro-4-trifluoromethylpentane can be prepared by the reaction of hydrogen with perfluoro-2-methyl-2-pentene. The designation of this compound in conventional nomenclature for halogen substituted hydrocarbons containing fluorine is HFC-54-11mmzf. Compositions containing HFC-54-11mmzf may also be prepared in accordance with procedures described in V. F. Snegirev et al., Bull. Acad. Sci. USSR, Div. Chem. Sci. [Eng. Trans.], (12), 2489 (1984).

HFC-54-11mmzf is miscible with various solvents conventionally used in cleaning operations. Compositions suitable for use in cleaning operations can be prepared which comprise a mixture of HFC-54-11mmzf with one or more compounds selected from the group consisting of alcohols, ethers, esters, ketones, nitromethane, acetonitrile, and halogenated hydrocarbons. The preferred alcohols and halogenated hydrocarbons contain from 1 to 4 carbon atoms; the preferred ethers contain from 2 to 6 carbon atoms; and the preferred esters and ketones contain from 3 to 6 carbon atoms. Examples of suitable alcohols include methanol, ethanol and isopropanol. Examples of suitable ethers include tetrahydrofuran and diethylether. Examples of suitable ketones include acetone and methylethylketone. Examples of suitable halogenated hydrocarbons include methylene chloride (i.e., dichloromethane), 1,1,2-trichloro-1,2,2-trifluoroethane, dichlorodifluoroethane, trichloroethene, and trans-1,2-dichloroethylene. Preferably, such compositions contain at least about 5 percent by weight of HFC-54-11mmzf; and can contain up to 99 percent by weight, or even more of HFC-54-11mmzf. Most preferred with respect to ozone depletion potential are compositions in which no component contains chlorine.

A composition which comprises an admixture of effective amounts of HFC-54-11mmzf and one or more solvents selected from the group consisting of alcohols, ethers, esters, ketones, nitromethane, acetonitrile, and halogenated hydrocarbons to form an azeotrope or azeotrope-like mixture, are considered especially useful. Compositions which are mixtures of HFC-54-11mmzf with an alcohol selected from the group consisting of methanol, ethanol and isopropanol, compositions which are mixtures of HFC-54-11mmzf with methylene chloride (i.e., dichloromethane), and compositions which are mixtures of HFC-54-11mmzf with acetonitrile are preferred.

By azeotrope or azeotrope-like is meant constant boiling liquid admixtures of two or more substances which admixtures behave like a single substance in that the vapor produced by partial evaporation or distillation has the same composition as the liquid, i.e., the admixtures distill without a substantial change in composition. Constant boiling compositions characterized as azeotropes or azeotrope-like exhibit either a maximum or minimum boiling point as compared with that of nonazeotropic mixtures of the same substances.

By effective amounts is meant the amounts of each component of the admixture of the instant invention, which, when combined, results in the formation of the azeotrope or azeotrope-like admixture of the instant invention.

It is possible to fingerprint, in effect, a constant boiling admixture, which may appear under varying guises depending on the conditions chosen, by any of several criteria.

The composition may be defined as an azeotrope of its components, say component A and component B, since the very term "azeotrope" is at once both definitive and limitive, requiring that effective amounts of A and B form this unique composition of matter which is a constant boiling admixture. It is well known by those who are skilled in the art that at differing pressures, the composition of a given azeotrope will vary, at least to some degree, and changes in distillation pressures also change, at least to some degree, the distillation temperatures. Thus, an azeotrope of A and B represents a unique type of relationship but with a variable composition depending on temperature and/or pressure. Therefore, compositional ranges, rather than fixed compositions, are often used to define azeotropes.

Or, the composition can be defined as a particular weight relationship or mole percent relationship of A and B, while recognizing that such specific values point out only one particular such relationship and that in actuality a series of such relationships represented by A and B actually exist for a given azeotrope, varied by influence of distillative conditions of temperature and pressure.

Or, recognizing that the azeotrope A and B does represent just such a series of relationships, the azeotropic series represented by A and B can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Azeotrope or azeotrope-like compositions are provided in accordance with this invention which comprise admixtures of effective amounts of HFC-54-11mmzf with an alcohol selected from the group consisting of methanol, ethanol and isopropanol, with the halogenated hydrocarbon methylene chloride, or with acetonitrile to form an azeotrope or azeotrope-like mixture.

In accordance with this invention, compositions which are binary mixtures of from about 87 to 95 weight percent HFC-54-11mmzf and from about 5 to 13 weight percent methanol are characterized as azeotropes or azeotrope-like in that mixtures within this range exhibit a substantially constant boiling point. Being substantially constant boiling, the mixtures do not tend to fractionate to any great extent upon evaporation. After evaporation, only a small difference exists between the composition of the vapor and the composition of the initial liquid phase. This difference is so small that the compositions of the vapor and liquid phases are considered substantially identical. Accordingly, any mixture within this range exhibits properties which are characteristic of a true binary azeotrope. The binary composition consisting essentially of about 91 weight percent HFC-54-11mmzf and about 9 weight percent methanol has been established, within the accuracy of the fractional distillation method, as a true binary azeotrope, boiling at about 49° C. at substantially atmospheric pressure and is a preferred azeotrope of this invention.

Also, in accordance with this invention, compositions which are binary mixtures of from about 90 to 98 weight percent HFC-54-11mmzf and from about 2 to 10 weight percent ethanol; compositions which are binary mixtures of from about 89 to 97 weight percent HFC-54-11mmzf and from about 3 to 11 weight percent isopropanol; compositions which are binary mixtures of from about 42 to 50 weight percent HFC-54-11mmzf and from about 50 to 58 weight percent dichloromethane; compositions which are binary mixtures of from about 91 to 99 weight percent HFC-54-11mmzf and from about 1 to 9 weight percent acetonitrile; are characterized as an azeotrope or azeotrope-like in that mixtures within this range exhibit a substantially constant boiling point. Being substantially constant boiling, the mixtures do not tend to fractionate to any great extent upon evaporation. After evaporation, only a small difference exists between the composition of the vapor and the composition of the initial liquid phase. This difference is so small that the compositions of the vapor and liquid phases are considered substantially identical. Accordingly, any mixture within this range exhibits properties which are characteristic of a true azeotrope.

The binary composition consisting essentially of about 94 weight percent HFC-54-11mmzf and about 6 weight percent ethanol has been established, within the accuracy of the fractional distillation method, as a true binary azeotrope, boiling at about 55° C. at substantially atmospheric pressure and is a preferred azeotrope of this invention.

The binary composition consisting essentially of about 93 weight percent HFC-54-11mmzf and about 7 weight percent isopropanol has been established, within the accuracy of the fractional distillation method, as a true binary azeotrope, boiling at about 57° C. at substantially atmospheric pressure and is a preferred azeotrope of this invention.

The binary composition consisting essentially of about 46 weight percent HFC-54-11mmzf and about 54 weight percent methylene chloride (i.e., dichloromethane) has been established, within the accuracy of the fractional distillation method, as a true binary azeotrope, boiling at about 35° C. at substantially atmospheric pressure and is a preferred azeotrope of this invention.

The binary composition consisting essentially of about 95 weight percent HFC-54-11mmzf and about 5 weight percent acetonitrile has been established, within the accuracy of the fractional distillation method, as a true binary azeotrope, boiling at about 61° C. at substantially atmospheric pressure and is a preferred azeotrope of this invention.

HFC-54-11mmzf, its azeotropes with methanol, ethanol, isopropanol, methylene chloride (i.e., dichloromethane), and acetonitrile, and other mixtures of this invention are useful in a wide variety of processes for cleaning solid surfaces which comprise treating said surface therewith. Applications include removal of flux and flux residues from printed circuit boards contaminated therewith.

The compositions of the invention may be used in conventional apparatus, employing conventional operating techniques. The solvent(s) may be used without heat if desired, but the cleaning action of the solvent may be assisted by conventional means (e.g. heating, agitation, etc.). In some applications (e.g. removing certain tenacious fluxes from soldered components) it may be advantageous to use ultrasonic irradiation in combination with the solvent(s).

The azeotropes of the present invention permit easy recovery and reuse of the solvent from vapor defluxing and degreasing operations because of their azeotropic nature. As an example, compositions provided in accordance with this invention can be used in cleaning processes such as is described in U.S. Pat. No. 3,881,949 and U.S. Pat. No. 4,715,900, both of which are incorporated herein by reference.

The azeotropes and other mixtures of the instant invention can be prepared by any convenient method including mixing or combining the desired amounts of the components. A preferred method is to weigh the desired amounts of each component and thereafter combine them in an appropriate container.

Practice of the invention will become further apparent from the following non-limiting examples.

EXAMPLES

EXAMPLE 1

Preparation of
1,1,1,2,2,5,5,5-Octafluoro-4-trifluoromethylpentane
(HFC-54-11mmzf)

The catalyst, a mixture of 50 g 0.5% Pd/C and 100 g $Al_2O_3$, was dried with nitrogen at 300° C. The temperature was lowered to 200° C. Hydrogen (100 mL/min) and perfluoro-2-methylpent-2-ene (10 mL/hr) were fed to the catalyst and the effluent collected at −78° C. The crude product was 0.5% starting material, 98% HFC-54-11mmzf and 1.5% 1,1,1,2,2,3,5,5,5-nonafluoro-4-trifluoromethylpentane. Distillation gave cuts at 60°-61° C. (1 atm) which were >99% HFC-54-11mmzf.

EXAMPLE 2

HFC-54-11mmzf/Methanol

HFC-54-11mmzf (10 g) and methanol (2 g) were combined and the mixture was distilled using a concentric tube still. The boiling point and composition of the distillates were monitored for azeotrope formation. A constant boiling azeotrope was formed which had a boiling point of about 48.7° C. Gas chromatographic analysis showed that the azeotrope consisted of 91.5% HFC-54-11mmzf and 8.5% methanol.

EXAMPLE 3

HFC-54-11mmzf/Ethanol

HFC-54-11mmzf (15 g) and ethanol (5 g) were combined and the mixture was distilled using a concentric tube still. The boiling point and composition of the distillates were monitored for azeotrope formation. A constant boiling azeotrope was formed which had a boiling point of about 54.5° C. Gas chromatographic analysis showed that the azeotrope consisted of 94.0% HFC-54-11mmzf and 6.0% ethanol.

EXAMPLE 4

HFC-54-11mmzf/Isopropanol

HFC-54-11mmzf (15 g) and isopropanol (5 g) were combined and the mixture was distilled using a concentric tube still. The boiling point and composition of the distillates were monitored for azeotrope formation. A constant boiling azeotrope was formed which had a boiling point of about 57.4° C. Gas chromatographic analysis showed that the azeotrope consisted of 92.7% HFC-54-11mmzf and 7.3% isopropanol.

EXAMPLE 5

HFC-54-11mmzf/Acetonitrile

HFC-54-11mmzf (15 g) and acetonitrile (5 g) were combined and the mixture was distilled using a concentric tube still. The boiling point and composition of the distillates were monitored for azeotrope formation. A constant boiling azeotrope was formed which had a boiling point of about 60.8° C. Gas chromatographic analysis showed that the azeotrope consisted of 94.9% HFC-54-11mmzf and 5.1% acetonitrile.

EXAMPLE 6

HFC-54-11 mmzf/Methylene chloride

HFC-54-11mmzf (15 g) and methylene chloride (10 g) were combined and the mixture was distilled using a concentric tube still. The boiling point and composition of the distillates were monitored for azeotrope formation. A constant boiling azeotrope was formed which had a boiling point of about 35.2° C. Gas chromatographic analysis showed that the azeotrope consisted of 45.8% HFC-54-11mmzf and 54.2% methylene chloride.

Surface cleaning using a composition of this invention is represented by the prophetic example which follows:

EXAMPLE 7

Surface Cleaning with HFC-54-11mmzf/Methanol Azeotrope

A single-sided circuit board is coated with activated rosin flux, and soldered by passing the board over a preheater to obtain a top side board temperature of approximately 200° F. and then through 500° F. molten solder. The soldered board is defluxed in an azeotropic mixture of about 91 weight percent HFC-54-11mmzf and about 9 weight percent methanol by suspending it, first for three minutes in the boiling sump, then one minute in the rinse sump and, thereafter, for one minute in the solvent vapor above the boiling sump. The board thus cleaned has no visible residue remaining on it.

Particular embodiments of the invention are included in the examples. Other embodiments will become apparent to those skilled in the art from a consideration of the specification or practice of the invention disclosed herein. It is understood that modifications and variations may be practiced without departing from the spirit and scope of the novel concepts of this invention. It is further understood that the invention is not confined to the particular formulations and examples herein illustrated, but it embraces such modified forms thereof as come within the scope of the following claims.

What is claimed is:

1. A process for cleaning a solid surface comprising treating said solid surface with a mixture consisting essentially of an azeotrope or azeotrope-like composition having a boiling point of about 49° C. at substantially atmospheric pressure and consisting of from about 87 to 95 weight percent 1,1,1,2,2,5,5,5-octafluoro-4-trifluoromethylpentane and from about 5 to 13 weight percent methanol, having a boiling point of about 55° C. at substantially atmospheric pressure and consisting of from about 90 to 98 weight percent 1,1,1,2,2,5,5,5-octafluoro-4-trifluoromethylpentane and from about 2 to 10 weight percent ethanol, having a boiling point of about 57° C. at substantially atmospheric pressure and consisting essentially of from about 89 to 97 weight percent 1,1,1,2,2,5,5,5-octafluoro-4-trifluoromethylpentane and from about 3 to 11 weight percent isopropanol, having a boiling point of about 35° C. at substantially atmospheric pressure and consisting essentially of from about 42 to 50 weight percent 1,1,1,2,2,5,5,5-octafluoro-4-trifluoromethylpentane and from about 50 to 58 weight percent dichloromethane, or having a boiling point of about 61° C. at substantially atmospheric pressure and consisting essentially of from about 91 to 99 weight percent 1,1,1,2,2,5,5,5-octafluoro-4-trifluoromethylpentane and from about 1 to 9 weight percent acetonitrile.

2. The process of claim 1 wherein the solid surface is treated with a mixture consisting essentially of an azeotrope or azeotrope-like composition consisting of from about 87 to 95 weight percent 1,1,1,2,2,5,5,5-octafluoro-4-trifluoromethylpentane and from about 5 to 13 weight percent methanol.

3. The process of claim 1 wherein the solid surface is treated with a mixture consisting essentially of an azeotrope or azeotrope-like composition consisting of about 91 weight percent 1,1,1,2,2,5,5,5-octafluoro-4-trifluoromethylpentane and about 9 weight percent methanol.

4. The process of claim 1 wherein the solid surface is treated with a mixture consisting essentially of an azeotrope or azeotrope-like composition consisting from about 90 to 98 weight percent 1,1,1,2,2,5,5,5-octafluoro-4-trifluoromethylpentane and from about 2 to 10 weight percent ethanol.

5. The process of claim 1 wherein the solid surface is treated with a mixture consisting essentially of an azeotrope or azeotrope-like composition consisting of about 94 weight percent 1,1,1,2,2,5,5,5-octafluoro-4-trifluoromethylpentane and about 6 weight percent ethanol.

6. The process of claim 1 wherein the solid surface is treated with an azeotrope or azeotrope-like composition consisting essentially of from about 89 to 97 weight percent 1,1,1,2,2,5,5,5-octafluoro-4-trifluoromethylpentane, and from about 3 to 11 weight percent isopropanol..

7. The process of claim 1 wherein the solid surface is treated with an azeotrope or azeotrope-like composition consisting essentially of about 93 weight percent 1,1,1,2,2,5,5,5-octafluoro-4-trifluoromethylpentane and about 7 weight percent isopropanol.

8. The process of claim 1 wherein the solid surface is treated with an azeotrope or azeotrope-like composition consisting essentially of from about 42 to 50 weight percent 1,1,1,2,2,5,5,5-octafluoro-4-trifluoromethylpentane and has about 50 to 58 weight percent dichloromethane.

9. The process of claim 1 wherein the solid surface is treated with an azeotrope or azeotrope-like composition consisting essentially at about 46 weight percent 1,1,1,2,2,5,5,5-octafluoro-4-trifluoromethylpentane and about 54 weight percent dichloromethane.

10. The process of claim 1 wherein the solid surface is treated with an azeotrope or azeotrope-like composition consisting essentially of from about 91 to 99 weight percent 1,1,1,2,2,5,5,5-octafluoro-4-trifluoromethylpentane and from about 1 to 9 weight percent acetonitrile..

11. The process of claim 1 wherein the solid surface is treated with an azeotrope or azeotrope-like composition consisting essentially of about 95 weight percent 1,1,1,2,2,5,5,5-octafluoro-4-trifluoromethylpentane and about 5 weight percent acetonitrile.

12. The process of claim 1, wherein said surface is treated with a mixture in which no component contains chlorine.

13. The process of claim 1, wherein the solid surface is a printed circuit board contaminated with flux and flux residues.

* * * * *